US007210604B2

(12) United States Patent
Kostal et al.

(10) Patent No.: US 7,210,604 B2
(45) Date of Patent: May 1, 2007

(54) BATON HOLDER

(76) Inventors: Bretislav Kostal, Zelivecka 12, 15000 Prague 10 (CZ); Vladimir Kupa, Frant. Sramka 15, 15000 Prague 5 (CZ)

( * ) Notice: Subject to any disclaimer, the term of this patent is extended or adjusted under 35 U.S.C. 154(b) by 416 days.

(21) Appl. No.: 10/795,488

(22) Filed: Mar. 8, 2004

(65) Prior Publication Data

US 2004/0178237 A1 Sep. 16, 2004

(30) Foreign Application Priority Data

Mar. 12, 2003 (CZ) ..... PV 2003-727

(51) Int. Cl.
*A01K 97/04* (2006.01)

(52) U.S. Cl. ..... 224/200; 224/197

(58) Field of Classification Search ..... 224/200, 224/197

See application file for complete search history.

(56) References Cited

U.S. PATENT DOCUMENTS 5,263,619 A 11/1993 Shoemaker
5,697,071 A * 12/1997 Fan ..... 455/575.9
5,772,089 A 6/1998 Parsons et al.
6,059,157 A 5/2000 Parsons et al.
6,497,349 B1 * 12/2002 Ramirez ..... 224/245

* cited by examiner

*Primary Examiner*—Jes F. Pascua
*Assistant Examiner*—Lester L. Vanterpool
(74) *Attorney, Agent, or Firm*—Collard & Roe, P.C.

(57) ABSTRACT

A baton holder consisting of at least one portion comprising the means adjustable into an opened position for insertion in and withdrawing of a baton from the holder and into a closed position for fixing the baton in the holder where the holder comprises an outer portion and an inner portion mounted for longitudinally motion in the outer portion along the longitudinal axis of the holder whereby the outer portion and the inner portion are provided by mutually cooperating elements (21, 24; 11, 14) permitting the inner portion to open in the opened position of the holder and to close and fix the baton body in the closed position of the holder. The inner portion consists of a cradle (2) having a generally opened cylindrical outer surface (201) and a cylindrical inner surface (20) and the outer portion consists of an opened elongated body (1) having a generally internal cylindrical surface (10) to support said cradle (2).

10 Claims, 3 Drawing Sheets

BATON HOLDER

FIELD OF THE INVENTION

The invention relates to a baton holder consisting of at least one portion comprising means adjustable into an opened position for insertion in and withdrawing of a baton from the holder and into a closed position for fixing the baton in the holder. The holder is adapted for holding the baton on a belt of law enforcement personnel, police officers etc.

DESCRIPTION OF THE PRIOR ART

Batons represent one of conventionally used devises of the law enforcement personnel. At this time the preferred types of batons are expandable batons having a handle adapted for receiving a telescopic shaft, whereby the dimensions of the handle and the shaft are substantially standardized. Nevertheless, baton holders may occur in various types and with variety of functions. The holders are secured to the belt of the respective person by means of a clip forming a part of the holder or mounted on the holder and optionally releasable therefrom.

The U.S. Pat. No. 5,263,619 discloses a baton holder consisting of a cylindrical housing provided at its lower end with a shoulder for engaging a baton handle while enabling a telescopic shaft to extend out of the holder. The upper end of the housing carries a cover flap provided with release securing means such as a snap fastener. With the exception of the cover flap performing a partially fixing function the position of the baton in the housing is not firmly fixed. Before using the baton first the cover flap is to be released so that the action of the officer is delayed, what may cause that he can be exposed to a sudden unauthorized action of an attacker.

The U.S. Pat. Nos. 5,772,089 and 6,059,157 are concentrated inter alia to the fixing of a baton in a housing without the necessity to use an upper cover. The housing has on its portion adjacent to the belt a dual wall defining a cavity in which a resilient friction shoe is located. The shoe protrudes in the opened position of the holder into the inner cylindrical space of the housing. Upon insertion of the baton into the housing the shoe is pressed into the cavity and by means of another manually operated means such as a cinch bar is pressed towards the baton handle and thus secures the position of the baton in the housing of the holder. The mere insertion of the baton into the holder interior passage does not provide sufficient grip of the baton by the holder and therefore additional hand operated means shall be used to this effect. Moreover, the baton holder shows a number of components and is thus susceptible to higher manufacturing costs and rather complicated operating. A front side longitudinal slit of the holder housing enables the withdrawal of a telescopic baton in both the axial and radial direction if the baton is in its extended configuration. Nevertheless, upon spreading the slit considerable resistance of the resilient side wall is to be overcome. Moreover, the placing of the baton into the housing laterally in radial direction is impossible and the baton may be inserted in the holder only from its upper end along the longitudinal axis of the holder.

SUMMARY OF THE INVENTION

The primary object of the invention is to provide a safe holding of the baton in both retracted and expanded configuration, whereby the position of the baton in the holder is automatically fixed when a baton handle is inserted into the holder. Another object of the invention is to enable the placing and removal of the expanded baton not only along the longitudinal axis of the holder but also laterally in radial direction. Still another object of the invention is that the holder includes minimum construction parts and its operation is easy and comfortable.

The present invention provides a baton holder consisting of at least one portion comprising means adjustable into an opened position for insertion in and withdrawing of a baton from the holder and into a closed position for fixing the baton in the holder and into a closed position for fixing the baton, wherein the baton comprises an outer portion and an inner portion mounted for longitudinally motion in the outer portion along the longitudinal axis of the holder whereby the outer portion and the inner portion are provided by mutually cooperating elements permitting the inner portion to open in the opened position of the holder and to close and fix the baton body in the closed position of the holder. Thus the baton may be easily and without any substantial resistance inserted into the holder, the inner portion of which takes its open position while the safe and fixed stowing in the holder is achieved by slightly pressing the baton handle downwardly. The movable inner portion of the holder is so displaced into a position, in which due to the mutual cooperation of said elements the baton handle is firmly gripped by the inner portion and is safely stowed in the holder.

More specifically, the inner portion may consist of a cradle having an opened outer and inner cylindrical surface and the outer portion consists of an opened elongated body having an internal cylindrical surface to support said cradle. The opened surface of the cradle and of the body enables the baton to be placed and removed from the holder in radial direction and not only along its axial axis.

In other improved features of the present invention, the cradle includes longitudinal margins with opposite situated projections and a head at its upper end while the body includes edges provided by opposite situated cut-outs to receive said projections and a collar to receive said head in the opened position of the holder.

Further the cradle has an abutment at its lower end extending into the inner space of the cradle and provided by a recess for receiving a shaft of the baton in its expanded condition and the lower end of the body has a foot with a shoulder extending into the internal space of the body provided by a recess for receiving the shaft of the baton. The collar of the body has an inner shoulder. The above described elements provide for a consistent fixing of the internal portion—cradle in both the opened and closed position.

To enable a safe stowing of a telescopic baton with the expanded shaft and to prevent the shaft from a spontaneous release from the handle, when the baton is stowed in the retracted condition, the foot has a slot on its outer surface to receive a clamp having outer arms an resilient inner arms, that are inserted into the opposite situated openings in the wall of the foot slot and protrudes into the inner space of the body and the ends of the inner arms of the clamp are rounded. In placing an expanded baton into the holder the baton shaft is inserted between the resilient inner arms that firmly hold the shaft. When a retracted baton is stowed in the holder the closed arms prevent the baton shaft from its spontaneous release and from extending out of the baton handle.

In still another aspect of the invention the inner surface of the slot in the foot is provided by a cut-out and the inner surface of the clamp engaging the inner surface of the slot has a complementary projection to fit in cut-out. The clamp is thus safely positioned with respect to the foot of the body.

Other principal features and advantages of the invention will become apparent to those skilled in the art upon review of the following drawings the detailed description and the appended claims.

DESCRIPTION OF THE PREFERRED EMBODIMENT

Figure 5:
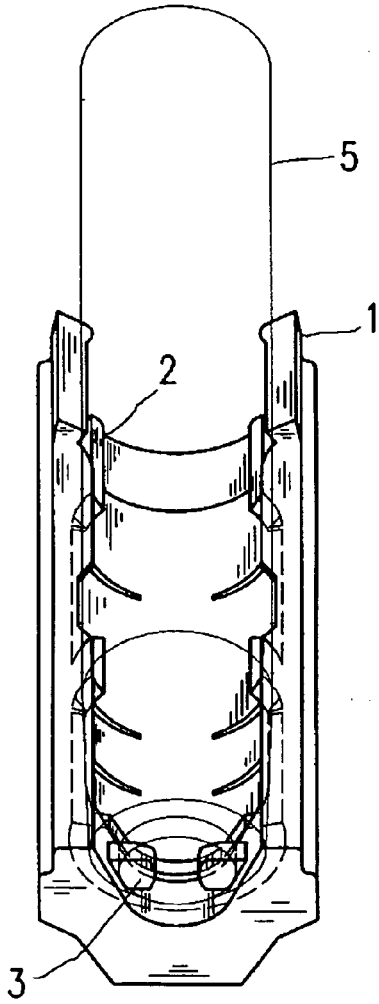
FIG. 5—is a front perspective view of a holder with a retracted baton schematically illustrated.
Figure 2:
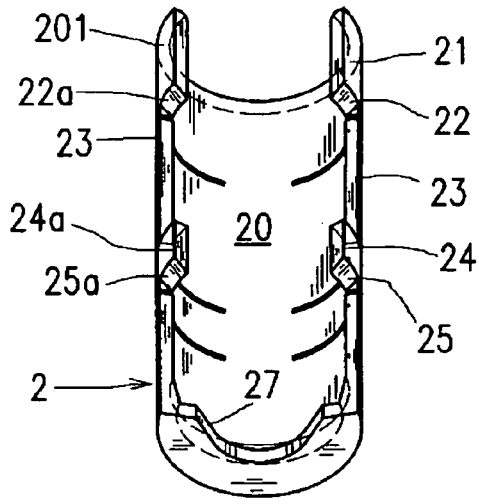
FIG. 2—is a front perspective view of a holder cradle.
Figure 7:
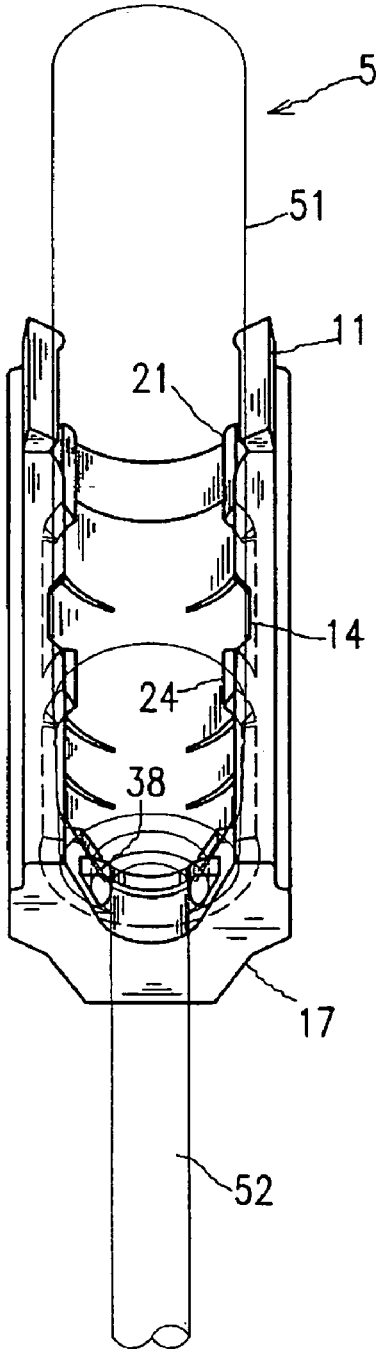
FIG. 7—is a front perspective view of a holder with an expanded baton schematically illustrated.

As shown in FIG. 1 to FIG. 4, a baton holder according to the invention consists substantially of three major parts: a trough-like body 1, a cradle mounted for longitudinal motion in the body 1 and a clamp 3. The holder is assigned to hold firmly a baton 5 having a handle 51 and a telescopic shaft 52, the outer lines of which are schematically illustrated in FIGS. 5 and 7.

Figure 1:
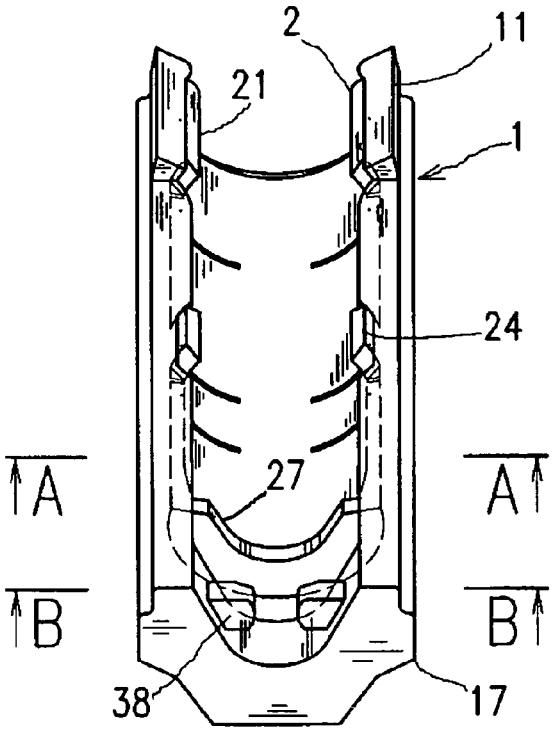
FIG. 1—is a front perspective view of a holder in the opened position.
Figure 1A:
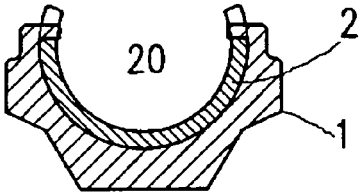
FIG. 1*a*—is a cross-sectional view along the line A—A of FIG. 1.
Figure 1B:
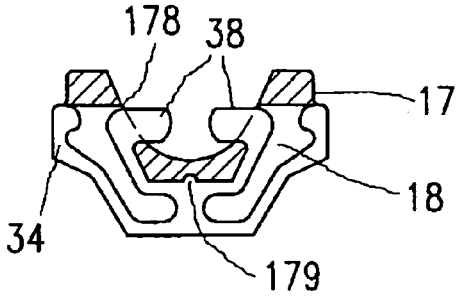
FIG. 1*b*—is a cross-sectional view along the line B—B of FIG. 1.
Figure 3:
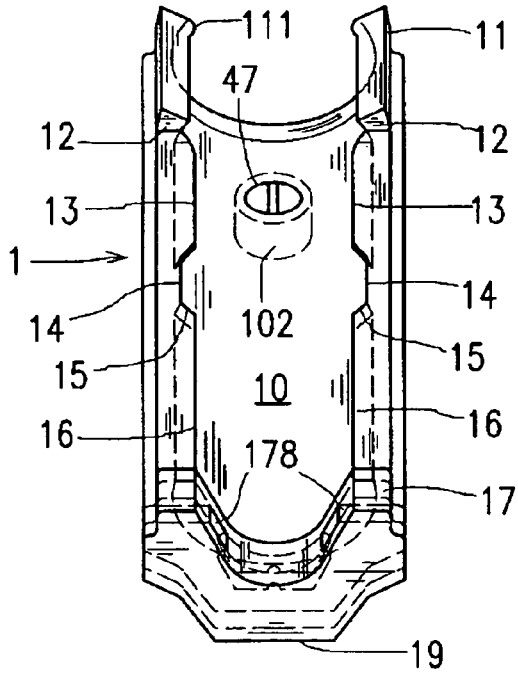
FIG. 3—is a front perspective view of a holder body.
Figure 4:
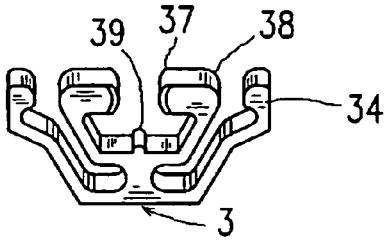
FIG. 4—is a front perspective view of a holder body clamp.
Figure 6:
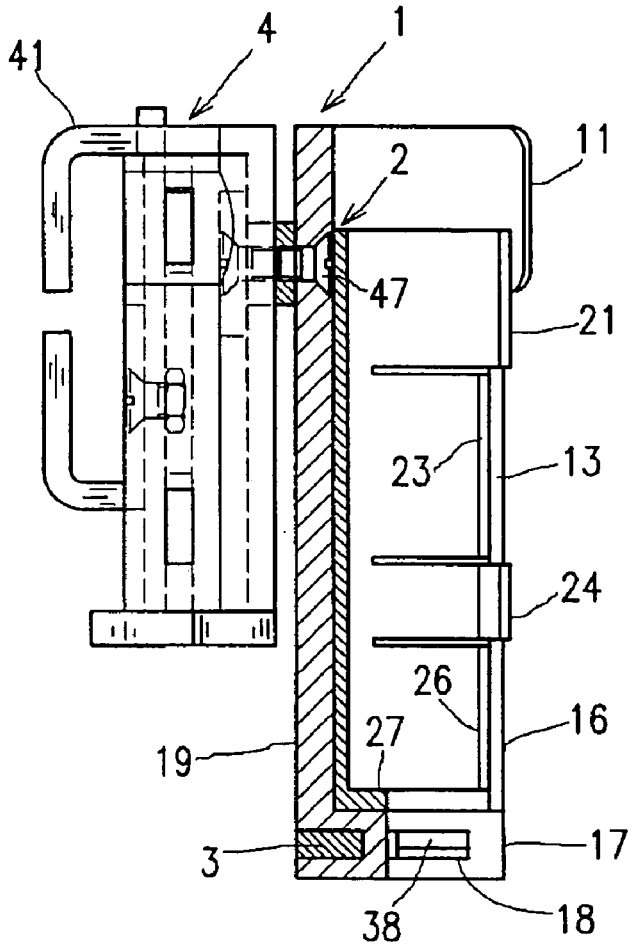
FIG. 6—is an axial sectional view of a holder with a belt attachment schematically illustrated.

As shown in more details in FIG. 3, the body 1 takes a shape of a trough with a partially plain back surface 19 and has an inner wall substantially in the form of a cylindrical surface 10. The longitudinal margins of the body 1 are provided by opposite situated edges 13 and 16 separated by cut-outs 14. The side walls 12, 15 of the edges 13, 16 are slanted. At its upper end the body 1 carries a collar 11 with a shoulder 111 and at its lower end the body is provided with a foot 17 (FIG. 6) extending over the inner wall of the body 1. The foot 17 has at its outer side a slot 18 and in the slot 18 two opposite openings 178 opened to the inner wall of the body 1 are provided. In addition, the bottom wall of the slot 18 has a cut-out 179 (FIG. 1*b*).

The cradle 2 (FIG. 2) has an outer cylindrical surface 201 and an inner cylindrical surface 20 and is supported for longitudinal motion by the inner cylindrical surface 10 of the body 1. The opposed boundaries of the cylindrical surfaces of the cradle 2 are defined by margins 23, opposite situated projections 24 and 24*a* with a slanted side walls 25 and 25*a* and by a head 21 at its upper end having the slanted side walls 22 and 22*a*. The lower end of the cradle 2 carries an abutment 27, which is provided with a circular recess, the diameter of which is slightly greater than the diameter of the extended shaft 52 of a standard baton 5. The inner diameter of the inner wall 20 of the clamp 2 is slightly greater than the outer diameter of the handle 51 of the baton 5.

The whole cradle 2 is made of a resilient material for example of plastics so that if the outer cylindrical surface 202 of the cradle 2 is exposed to an appropriate external pressure the internal diameter of the cradle is reduced to the value, which is lower than the outer diameter of a standard baton handle. Consequently, if the baton handle 51 is inserted into the cradle it may be gripped by the inner cylindrical surface 20 of the cradle 2 when exerting an appropriate external pressure on the cradle 2 (FIGS. 5 and 7).

The projections 24 and 24*a* and the head 21 of the cradle 2 are so dimensioned that they may be received by the cut-outs 14 and by the collar 11 of the body 1, when the cradle 2 is inserted into the body 1 and takes its opened position. In the central plane of the body 1 an opening 102 for a bolt joint 47 for securing the holder to a belt attachment member 4 (FIG. 3 and FIG. 6) is provided. By means of the member 4, which is not subject of this invention, or by its clips 41 respectively, the holder may be fastened to the baton user's belt not shown in the drawings.

The clamp 3 (FIG. 4) has a resilient internal arms 38 with rounded top ends 37 and external arms 34, wherein the link between the internal arms is provided with a projection 39 to fit in the cut-out 179 in the bottom wall of the slot 18, when the clamp is inserted into the slot 18. In this position the rounded ends 37 of the internal arms 38 protrude from the openings 178 in the inner cylindrical space of the body 1, the external arms 34 are disposed between the side walls of the slot 18 and the projection 39 fits in the cut-out 179. Thus the position of the clamp 3 in the slot 18 is secured in the foot 17 while permitting the transversal motion of the internal arms 38 in the openings 178.

The operation of the holder is as follows: When the baton 5 is not placed in the holder the cradle 2 takes its opened position so that the projections 24 and 24*a* are located in the cut-outs 14 of the body 1 and the head 21 of the cradle 2 is located in the collar 11 and engages the shoulder 111. (FIG. 1). Upon insertion of the baton into the holder 1 the lower end of the baton 5 first engages the abutment 27 of the cradle 2 and by further pressing the baton downwardly the cradle 2 is together with the baton 5 displaced into a position, where the abutment 27 leans against the foot 17 of the body 1. During said displacement motion the head 21 leaves the collar 11 so that it engages the opposite situated edges 13 of the body 1 and the projections 24 leave the cut-outs 14 of the body 1 to engage the opposite situated edges 16 of the body 1. The edges 13 urge the head 21 and the edges 16 urge the projections 24, 24*a* inwardly so that the cradle 2 clasps the baton handle 51 to ensure the firm stowing of the baton 5 in the holder. Upon removal of the baton from the holder the operation proceeds in inverse order so that by the motion of the baton 5 upwardly the cradle is displaced in the position where the projections 24, 24*a* fit in the cut-outs 14, the head 21 abuts the shoulder 111 of the collar 11 and the baton 5 is released from the clasping forces of the cradle 2. The easier displacement of the cradle 2 within the body 1 from the opened position to the closed position and vice versa is achieved by slanted side walls 15 and 12 of the edges 13 and 15, the slanted side walls 22, 22*a* of the head 21 and the slanted side walls 25, 25*a* of the projections 24 and 24*a* of the cradle 2.

Another function of the holder of the invention provides for insertion and fixing the baton 5 in the holder when the telescopic shaft extends from the handle 51 (FIG. 7). In this action first the extended shaft 52 is placed into the foot 17 of the body 1 so that by a pressure on the rounded ends 37 of the inner resilient inner arms 38 the arms 38 are urged sideways, whereupon when the shaft wall engages the foot 17 the inner arms 38 surround the shaft 52 of the baton 5 to secure the position of the shaft 52 between the arms 38. Thereafter the baton handle 51 may be placed in the holder in the manner described above. In its extended configuration the baton shaft 52 may extend from the holder downwardly and the baton user is not required to push the shaft 52 back into the handle 51 and may be free to perform immediately other actions. If the baton is stowed in the holder in its retracted configuration the clamp 3 i.e. its inner arms 38 serve as an abutment for the shaft outer end to prevent it from a spontaneous release out of the handle 51.

All parts of the holder may be made of any suitable material however preferably from a resistant plastic material. The holder may be adapted also for batons with a diameter of the handle substantially different from the standard size, for example by changing the thickness of the cradle wall or other holder dimensions.

INDUSTRIAL APPLICABILITY

The holder according to the invention represents an indispensable accessory of a baton as a conventional equipment of the law enforcement personnel using standard as well as non-standard sized batons, specifically telescopic expandable batons.

The invention claimed is:

1. A holder for a baton with an expandable shaft having at least one portion including means adjustable into an opened position for insertion in and withdrawal of the baton from the holder and into a closed position for fixing the baton in the holder, the holder comprising:

an outer portion consisting of an elongated body with an inner wall, first longitudinal margins an upper end, and a lower end;

at least one set of cut-outs situated opposite each other and provided in said first longitudinal margins of the body;

a cradle for receiving the baton and moving together longitudinally with the baton inside the outer portion, said cradle having its outer surface substantially compatible with the inner wall of the body and mounted for longitudinal motion in the body and comprising, second longitudinal margins, an upper end and a lower end;

at least one set of projections situated opposite each other and provided on said second longitudinal margins of the cradle and urged towards the inner wall of the body in the closed position of the holder and engaging said cut-outs in said first longitudinal margins of the body in the opened position of the holder.

2. The holder according to claim 1 wherein said cradle has a head at its upper end and an abutment at its lower end and said body has a collar at its upper end to receive said head in the opened position of said holder and a foot with an inner wall to engage said abutment in the closed position of the holder.

3. The holder of claim 2, wherein said abutment extends into the inner space of the cradle and has a recess for receiving a shaft of the baton in its expanded condition and said foot has a shoulder extending into the internal space of said body provided by a recess for receiving the shaft of the baton.

4. A holder according to claim 3, wherein said foot has a slot in its outer face intersecting opposite situated openings in its inner wall to receive a clamp having outer arms and resilient inner arms, which inner arms are inserted into said openings and protrude into the inner space of the body.

5. A holder according to claim 2 wherein the collar of the body has an inner shoulder to stop the head of the cradle in the opened position of the holder.

6. A holder according to claim 4 wherein said inner surface of said slot in said foot is provided by a cut-out and said inner surface of said clamp engaging said inner surface of said slot has a complementary projection to fit said cut out.

7. A holder according to claim 4 wherein said ends of said inner arms of said clamp are rounded.

8. A holder for a baton with an expandable shaft having at least one portion including means adjustable into an opened position for insertion in and withdrawal of the baton from the holder and into a closed position for fixing the baton in the holder, the holder comprising:

an outer portion consisting of an elongated body with an inner wall and first longitudinal margins and a collar at its upper end and a foot at its lower end and having a recess for a baton shaft;

cut-outs situated opposite each other and disposed in said first longitudinal margins of said body;

a cradle for receiving the baton and moving together longitudinally with the baton inside said outer portion having its outer surface substantially compatible with said inner wall of said body and mounted for longitudinal motion in said body and comprising second longitudinal margins and a head at its upper end for insertion into the collar in the opened position of the holder and an abutment at its lower end to engage said foot in the closed position of said holder;

projections situated opposite each other and disposed said second longitudinal margins of said cradle and urged towards the said inner wall of said body in the closed position of the holder and engaging said cut-outs in the first longitudinal margins of said body in the opened position of the holder;

means provided in the foot to hold the baton shaft inside said foot.

9. The holder according to claim 8, wherein said abutment extends into said inner space to stop the baton when inserted into said cradle and has a recess for receiving a shaft of the baton in its expanded condition and said foot has a shoulder extending into said internal space of the body provided by a recess for receiving said shaft of the baton in its extended position.

10. The holder according to claim 9, wherein said foot has a slot in its outer face intersecting said opposite situated openings on its inner face to receive a clamp having outer arms and resilient inner arms, wherein said inner arms are inserted into said openings and protrude into said inner space of said body.

* * * * *